US010910177B2

(12) United States Patent
Yuan et al.

(10) Patent No.: US 10,910,177 B2
(45) Date of Patent: Feb. 2, 2021

(54) KNIFE SWITCH

(71) Applicant: XUJI (XIAMEN) INTELLIGENT SWITCHGEAR MANUFACTURING CO., LTD., Fujian (CN)

(72) Inventors: Chuanzhen Yuan, Xiamen (CN); Xianpu Li, Xiamen (CN); Feifeng Fu, Xiamen (CN); Dongxu Lu, Xiamen (CN); Weijian Xiao, Xiamen (CN)

(73) Assignee: XUJI (XIAMEN) INTELLIGENT SWITCHGEAR MANUFACTURING CO., LTD., Fujian (CN)

( * ) Notice: Subject to any disclaimer, the term of this patent is extended or adjusted under 35 U.S.C. 154(b) by 0 days.

(21) Appl. No.: 16/691,530

(22) Filed: Nov. 21, 2019

(65) Prior Publication Data

US 2020/0168412 A1 May 28, 2020

(30) Foreign Application Priority Data

Nov. 28, 2018 (CN) ..... 2018 1 1470172

(51) Int. Cl.
*H01H 1/42* (2006.01)
*H01H 21/54* (2006.01)

(52) U.S. Cl.
CPC ..... *H01H 21/54* (2013.01); *H01H 1/42* (2013.01)

(58) Field of Classification Search
CPC ..... H01H 1/42; H01H 31/28; H01H 1/365; H01H 31/006; H01H 21/54; H01H 31/32; H01H 33/12; H01H 1/385; H01H 33/40; H01H 3/3052; H01H 33/666; H01H 2033/6667; H01H 33/166; H01H 33/42; H01H 3/46
See application file for complete search history.

(56) References Cited

U.S. PATENT DOCUMENTS 1,551,195 A * 8/1925 Hebden ..... H01H 1/58 200/282
1,748,724 A * 2/1930 Morger ..... H01H 1/54 335/195
6,787,725 B2 * 9/2004 Kim ..... H01H 33/905 218/43

(Continued)

FOREIGN PATENT DOCUMENTS

EP 0788126 * 8/1997 ..... H01H 33/40

*Primary Examiner* — Ahmed M Saeed
(74) *Attorney, Agent, or Firm* — Leong C. Lei

(57) ABSTRACT

A knife switch includes a switch housing, a conductive seat, a movable contact part, and a fixed contact part. The conductive seat, the movable contact part and the fixed contact part are disposed in the switch housing. One end of the movable contact part is electrically connected to the conductive seat. Another end of the movable contact part is formed with a conductive head. An outer surface of the conductive head is defined as a first conductive surface. An arc guide hole having a second conductive surface is disposed in the conductive head. The fixed contact part is provided with a contact finger to cooperate with the first conductive surface and an arc guide contact plate to cooperate with the second conductive surface. The knife switch can ensure the normal use of the main current path when the movable contact part and the fixed contact part are electrically connected.

3 Claims, 11 Drawing Sheets

(56) References Cited

U.S. PATENT DOCUMENTS

| | | | | |
|---|---|---|---|---|
| 7,528,336 | B2 * | 5/2009 | Hashimoto | H01H 33/40<br>200/400 |
| 8,371,265 | B1 * | 2/2013 | Call | F02D 17/04<br>123/332 |
| 2014/0001016 | A1 * | 1/2014 | Flegel | H01H 21/58<br>200/271 |
| 2017/0236657 | A1 * | 8/2017 | Kim | H02B 5/06<br>361/618 |

* cited by examiner

KNIFE SWITCH

BACKGROUND OF THE INVENTION

1. Field of the Invention

The present invention relates to a disconnect switch, and more particularly to a knife switch.

2. Description of the Prior Art

A disconnect switch is one of the most used electrical appliances in high-voltage switchgear, which is an electrical appliance that provides a disconnecting function in the circuit. The working principle and structure of the disconnect switch itself are relatively simple. However, due to the large amount of use and strict requirements for operational reliability, the disconnect switch has a greater impact on the design, establishment and safe operation of power substations and power plants. There are many types of disconnect switches depending on the site of use. A knife switch is a common type of disconnect switches. A conventional knife switch is generally composed of a movable contact part and a fixed contact part. When the knife switch is to be connected, the fixed contact part is electrically connected to the movable contact part through a contact finger disposed inside the fixed contact part, and the path of the busbar switching current is from the movable contact part to the contact finger and then to the fixed contact part. When the knife switch is to be disconnected, the contact finger of the fixed contact part is separated from the movable contact part. At this time, an electric arc is generated, and the arc is burned between the conductive surface of the movable contact part and the contact finger, which will seriously damage the conductive surface of the movable contact part and the contact finger to impact on the electrical conductivity between the movable and fixed contact parts of the knifed switch in a connected state. Accordingly, the inventor of the present invention has devoted himself based on his many years of practical experiences to solve these problems.

SUMMARY OF THE INVENTION

In view of the above question, the primary object of the present invention is to provide a knife switch, which can effectively prevent an electric arc from ablating a movable contact part and a contact finger, so as to ensure normal conductive performance of the knife switch.

In order to achieve the above object, the present invention adopts the following technical solutions:

A knife switch comprises a switch housing, a conductive seat, a movable contact part, and a fixed contact part. The conductive seat, the movable contact part and the fixed contact part are disposed in the switch housing. One end of the movable contact part is hinged to the conductive seat and electrically connected to the conductive seat. Another end of the movable contact part is formed with a conductive head. An outer surface of the conductive head is defined as a first conductive surface. The conductive head has an arc guide hole that is disposed in the conductive head and extends in a width direction of the movable contact part. An inner side surface of the arc guide hole is defined as a second conductive surface. The fixed contact part is provided with a groove to cooperate with the conductive head. The groove is provided with a contact finger to cooperate with the first conductive surface and an arc guide contact plate to cooperate with the second conductive surface.

Preferably, the contact finger is disposed on an inner side of the groove.

Preferably, the groove has an open end facing the movable contact part.

Preferably, the arc guide contact plate is an elastic structure.

Preferably, the arc guide contact plate includes two bottom ends, two sides and a top end. The two bottom ends of the arc guide contact part are fixed in the groove of the fixed contact part. The two sides are provided with protrusions.

In the present invention, the first conductive surface of the movable contact part is in contact with the contact finger of the fixed contact part to realize the electrical connection between the two, and "from the first conductive surface to the contact finger and to the fixed contact part" serves as a main current path between the movable and fixed contact parts. In addition, in the present invention, the arc guide contact plate is disposed in the fixed contact part, and the arc guide hole having the second conductive surface is disposed in the movable contact part. Through the arc guide contact plate to be in contact with the second conductive surface of the arc guide hole, "from the second conductive surface to the arc guide contact plate and then to the fixed contact part" serves as an auxiliary current path between the movable and fixed contact parts. When the knife switch performs a disconnecting operation, the first conductive surface is first separated from the contact finger, and the second conductive surface is still in contact with the arc guide contact plate. Thus, there is no electric arc generated between the first conductive surface of the movable contact part and the contact finger due to separation, thereby preventing the electric arc from ablating the first conductive surface and the contact finger, so that the main current path between the movable and fixed contact parts is not damaged, so as to ensure the normal conductive performance of the knife switch.

When the knife switch continues to perform the disconnecting operation, the arc guide contact plate is disengaged from the arc guide hole, and an electric arc is generated between the second conductive surface and the arc guide contact plate due to separation. Since the second conductive surface is formed in the arc guide hole, the electric arc burns only in the arc guide hole until it goes out. That is to say, through the arrangement of the arc guide contact plate and the arc guide hole, the electric arc between the movable and fixed contact parts burns only in the arc guide hole and does not move to other locations, thereby protecting the first conductive surface and the contact finger from electric arc ablation.

DETAILED DESCRIPTION OF THE PREFERRED EMBODIMENTS

Figure 1:
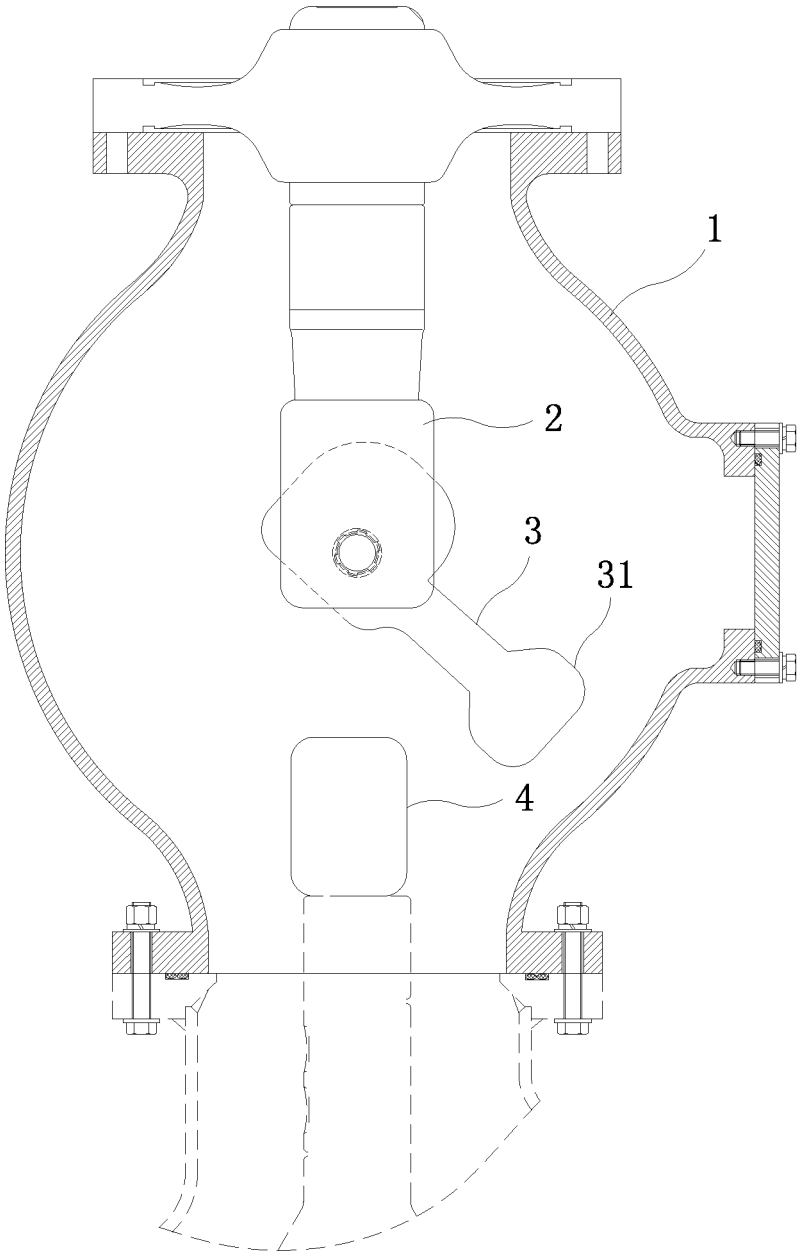
FIG. 1 is a schematic view of the knife switch of the present invention.
Figure 2:
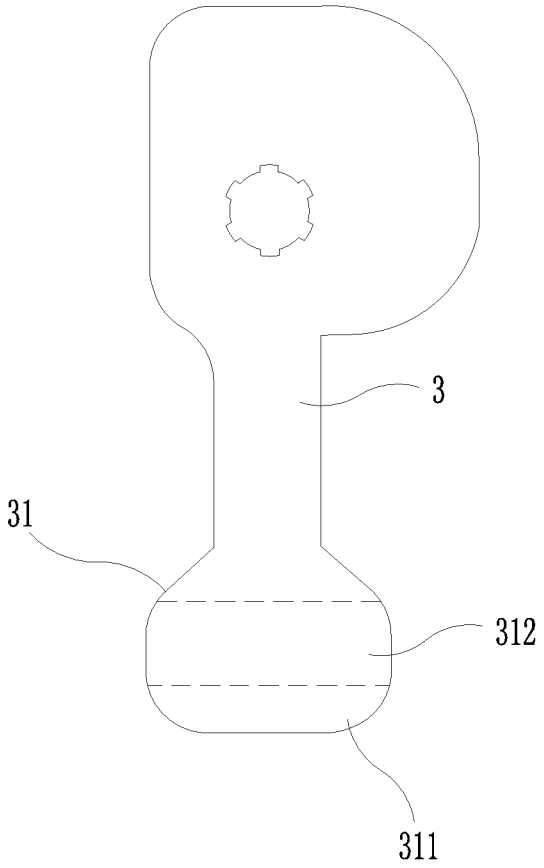
FIG. 2 is a front view of the movable contact part of the knife switch of the present invention.
Figure 3:
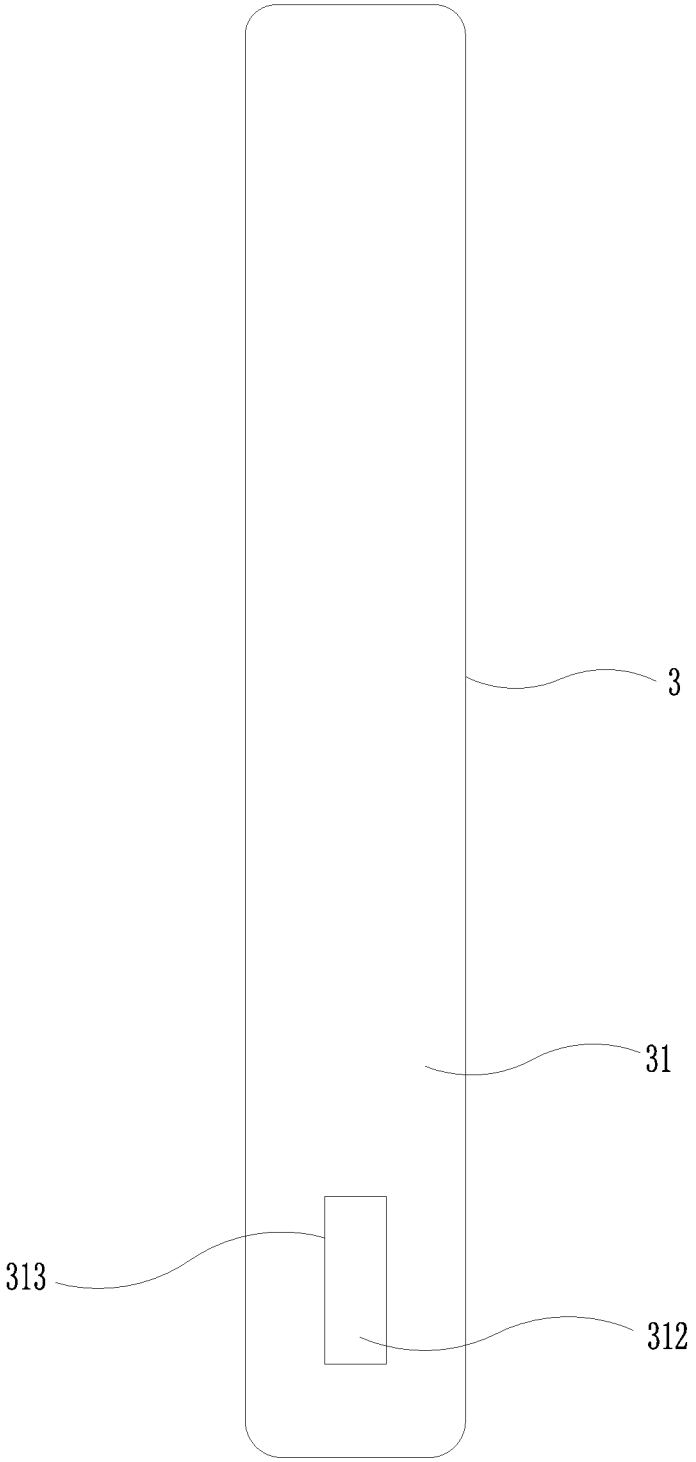
FIG. 3 is a side view of the movable contact part of the knife switch of the present invention.
Figure 4:
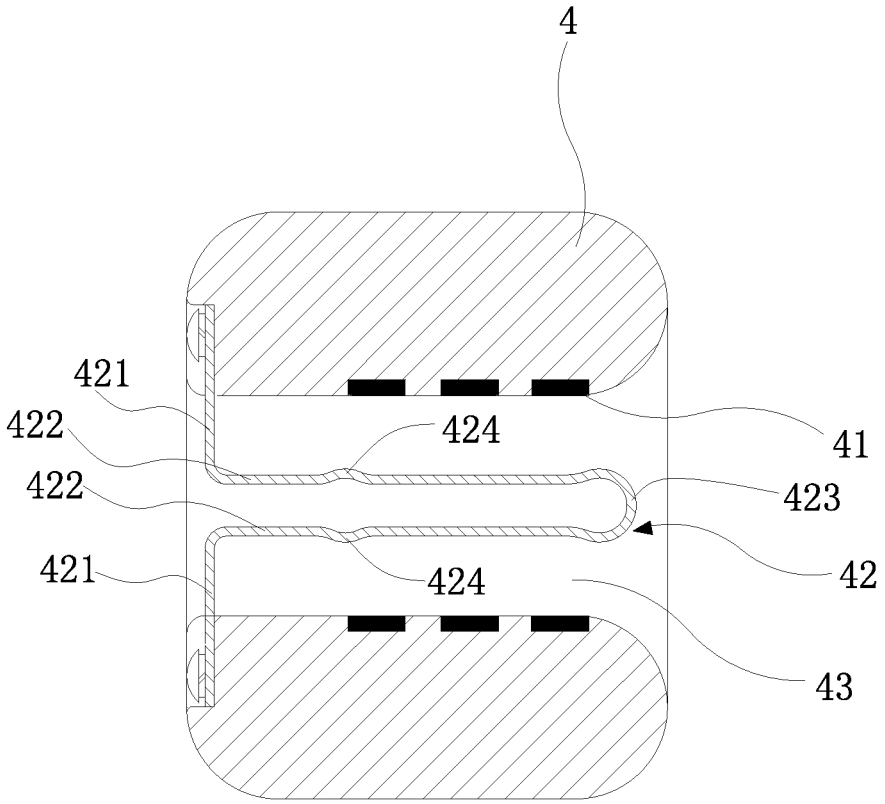
FIG. 4 is a cross-sectional view of the fixed contact part of the knife switch of the present invention.
Figure 5:
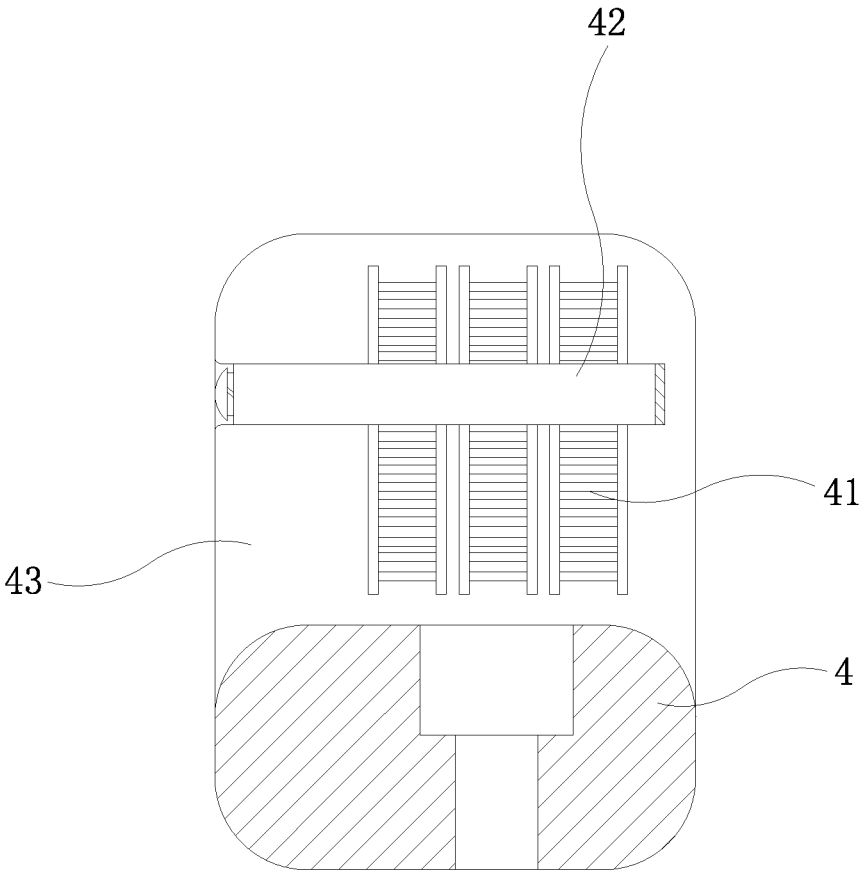
FIG. 5 is another cross-sectional view of the fixed contact part of the knife switch of the present invention.

Embodiments of the present invention will now be described, by way of example only, with reference to the accompanying drawings.

As shown in FIG. 1 through FIG. 5, the present invention discloses a knife switch. The knife switch comprises a switch housing 1, a conductive seat 2, a movable contact part 3, and a fixed contact part 4. The conductive seat 2, the movable contact part 3 and the fixed contact part 4 are disposed in the switch housing 1. One end of the movable contact part 3 is hinged to the conductive seat 2 and electrically connected to the conductive seat 2. Another end of the movable contact part 3 is formed with a conductive head 31. The outer surface of the conductive head 31 is defined as a first conductive surface 311. The conductive head 31 has an arc guide hole 312 that is disposed in the conductive head 31 and extends in the width direction of the movable contact part 3. The inner side surface of the arc guide hole 312 is defined as a second conductive surface 313. The fixed contact part 4 is provided with a groove 43 to cooperate with the conductive head 31. The groove 43 has an open end facing the movable contact part 3. The inner side of the groove 43 of the fixed contact part 4 is provided with a contact finger 41. The groove 4 is provided with an arc guide contact plate 42 that is received in the arc guide hole 312.

Figure 6:
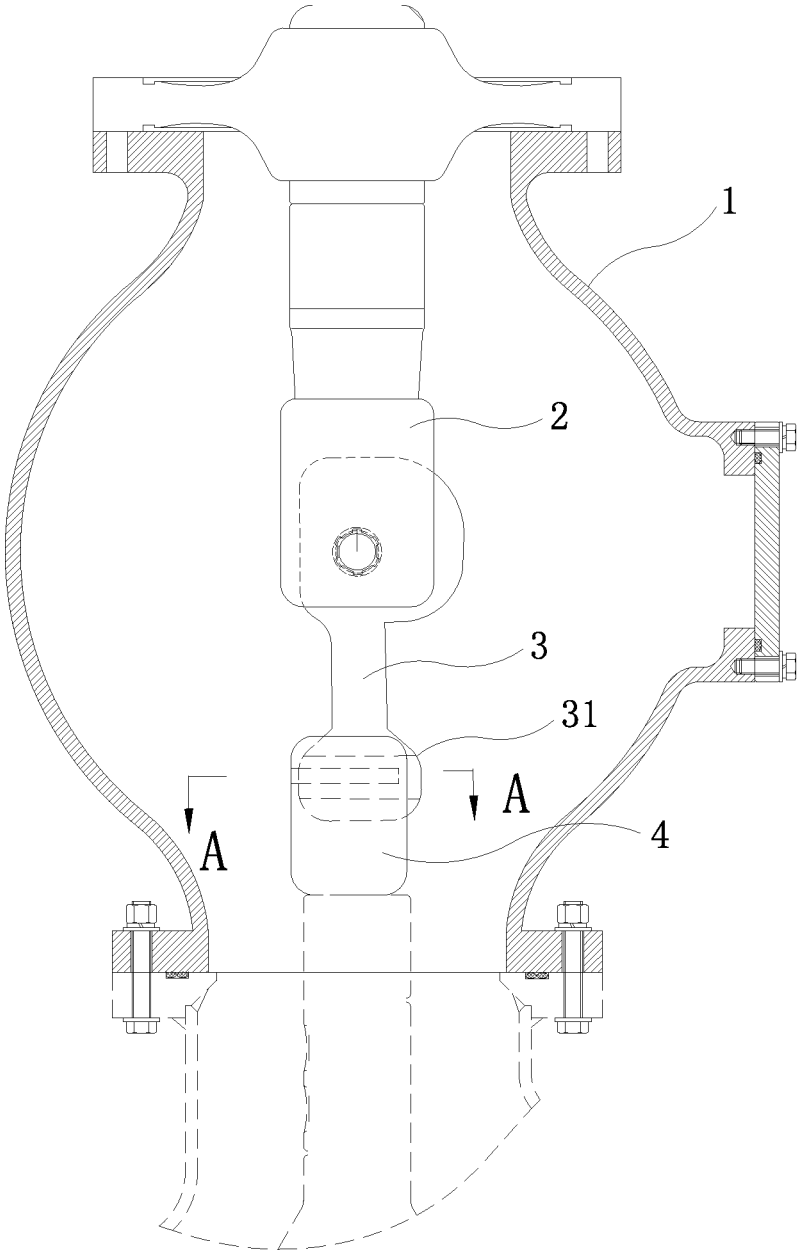
FIG. 6 is a schematic view of the knife switch in a connected state of the present invention.
Figure 7:
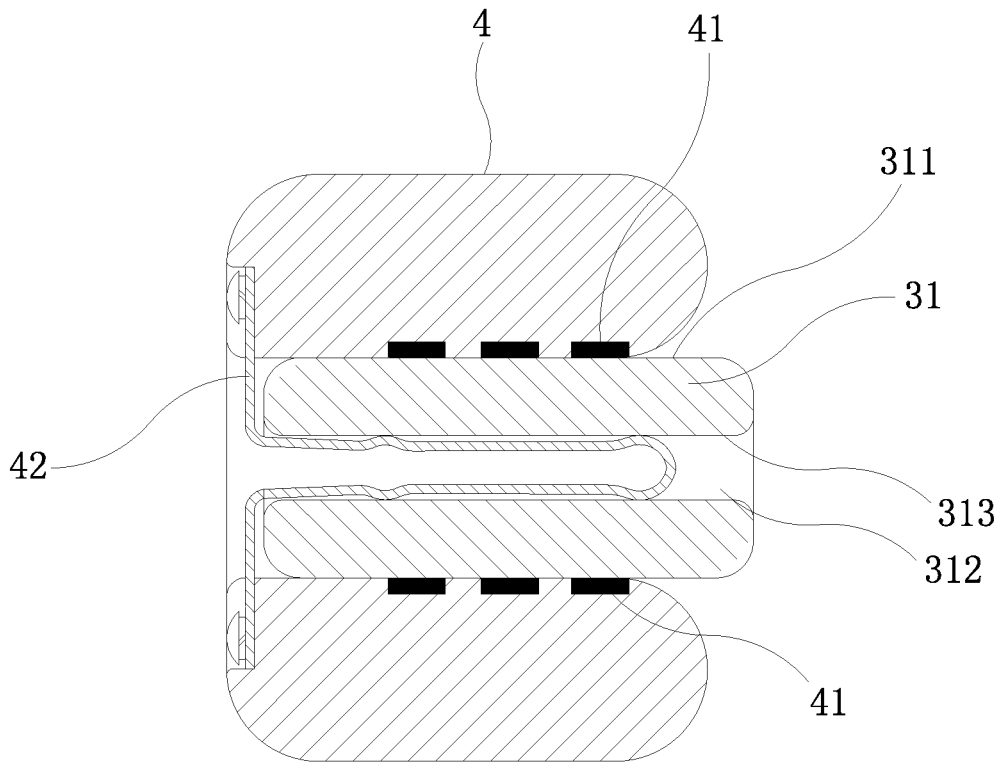
FIG. 7 is a cross-sectional view taken along line A-A of FIG. 6.

As shown in FIG. 6 and FIG. 7, when the knife switch is in a connected state, the movable contact part 3 is in contact with the fixed contact part 4. Specifically, the movable contact part 3 rotates toward the fixed contact part 4, so that the conductive head 31 is inserted into the groove 43 of the fixed contact part 4, and the arc guide contact plate 42 of the fixed contact part 4 is inserted into the arc guide hole 312 of the conductive head 31. The first conductive surface 311 of the conductive head 3 is in contact with the contact finger 41, and the arc guide contact plate 42 is in contact with the second conductive surface 313 of the conductive head 31 to realize the electrical connection between the movable and fixed contact parts. At this time, the current of the knife switch includes the opening and closing busbar switching current, and the path includes two paths: from the first conductive surface 311 of the movable contact part 3 to the contact finger 41 and then to the fixed contact part 4 (this is the main path); from the second conductive surface 313 of the movable contact part 3 to the arc guide contact plate 42 and then to the fixed contact part 4.

Figure 8:
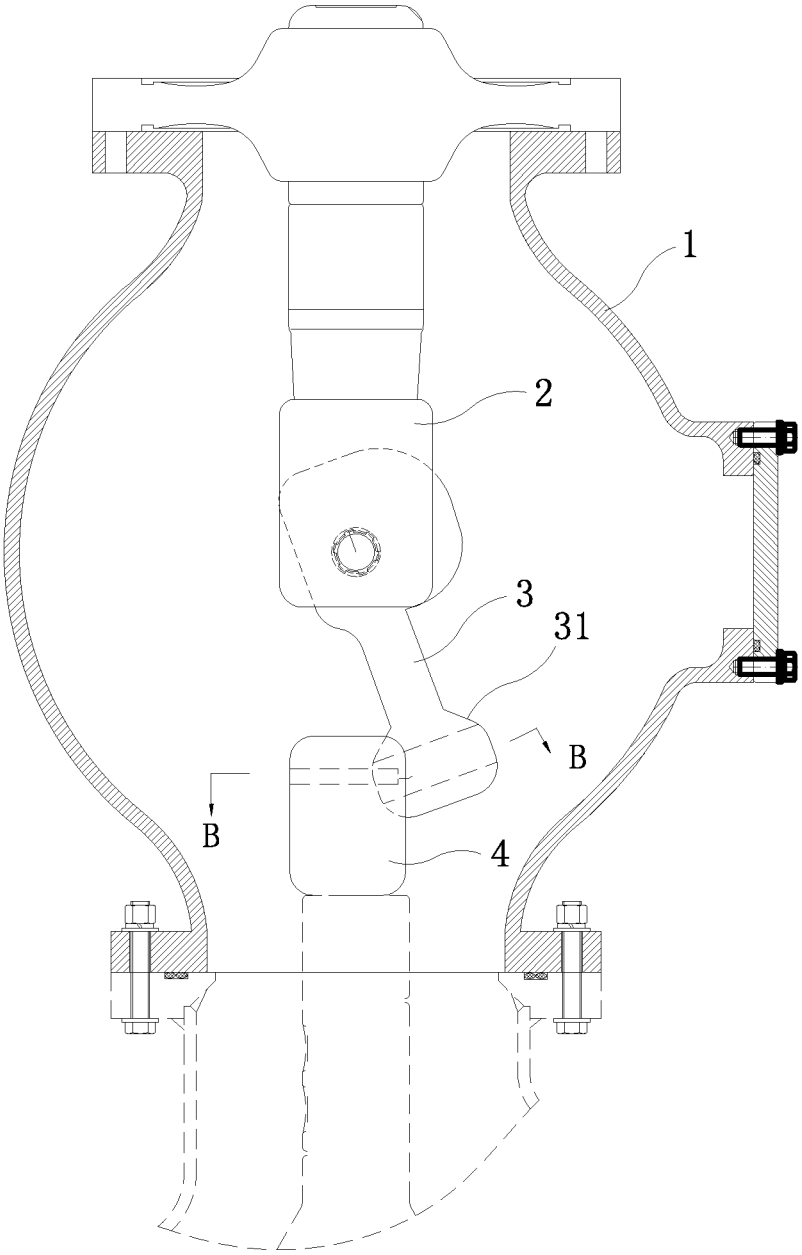
FIG. 8 is a schematic view of the knife switch in a disconnected state of the present invention (the movable contact part is partially separated from the fixed contact part)
Figure 9:
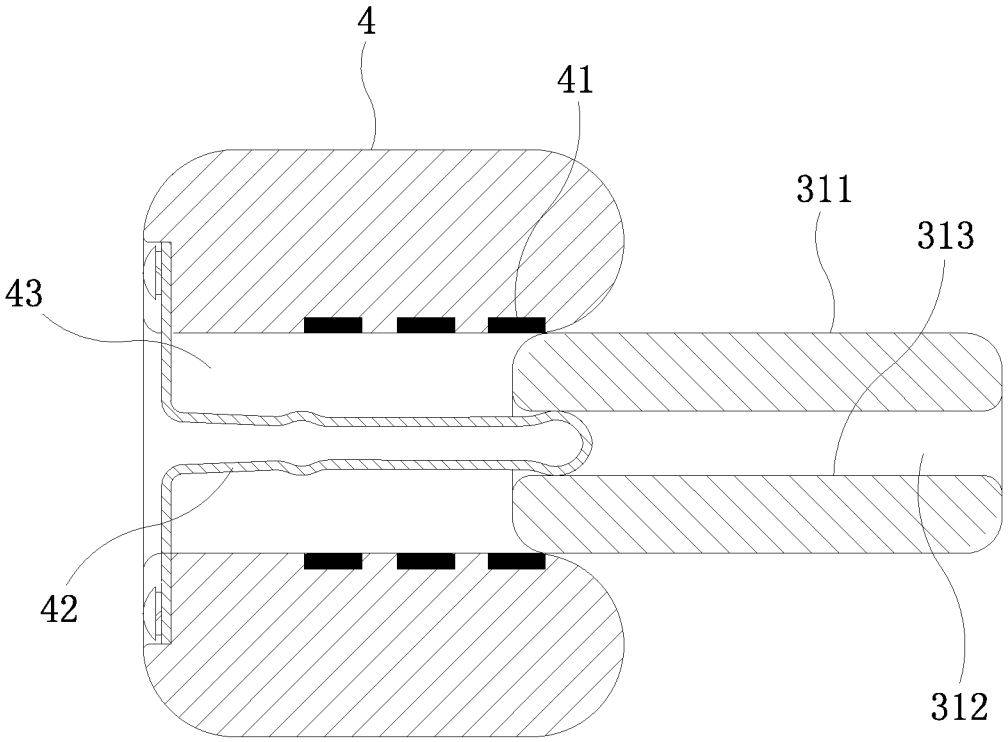
FIG. 9 is a cross-sectional view taken along line B-B of FIG. 8.

As shown in FIG. 8 and FIG. 9, when the knife switch is just about to disconnect, the movable contact part 3 rotates away from the fixed contact part 4. The first conductive surface 311 of the movable contact part 3 is separated from the contact finger 41, and the second conductive surface 313 of the movable contact part 3 is still in contact with the arc guide contact plate 42. At this time, the change of the path of the opening and closing busbar switching current is from the second conductive surface 313 of the movable contact part 3 to the arc guide contact plate 42 and then to the fixed contact part 4. That is to say, at this time, there is no electric arc generated between the first conductive surface 311 of the movable contact part 3 and the contact finger 41 due to separation, thereby preventing the electric arc from ablating the first conductive surface 311 and the contact finger 41, so as to ensure the normal use of the main current path when the movable contact part 3 is electrically connected to the fixed contact part 4.

Figure 10:
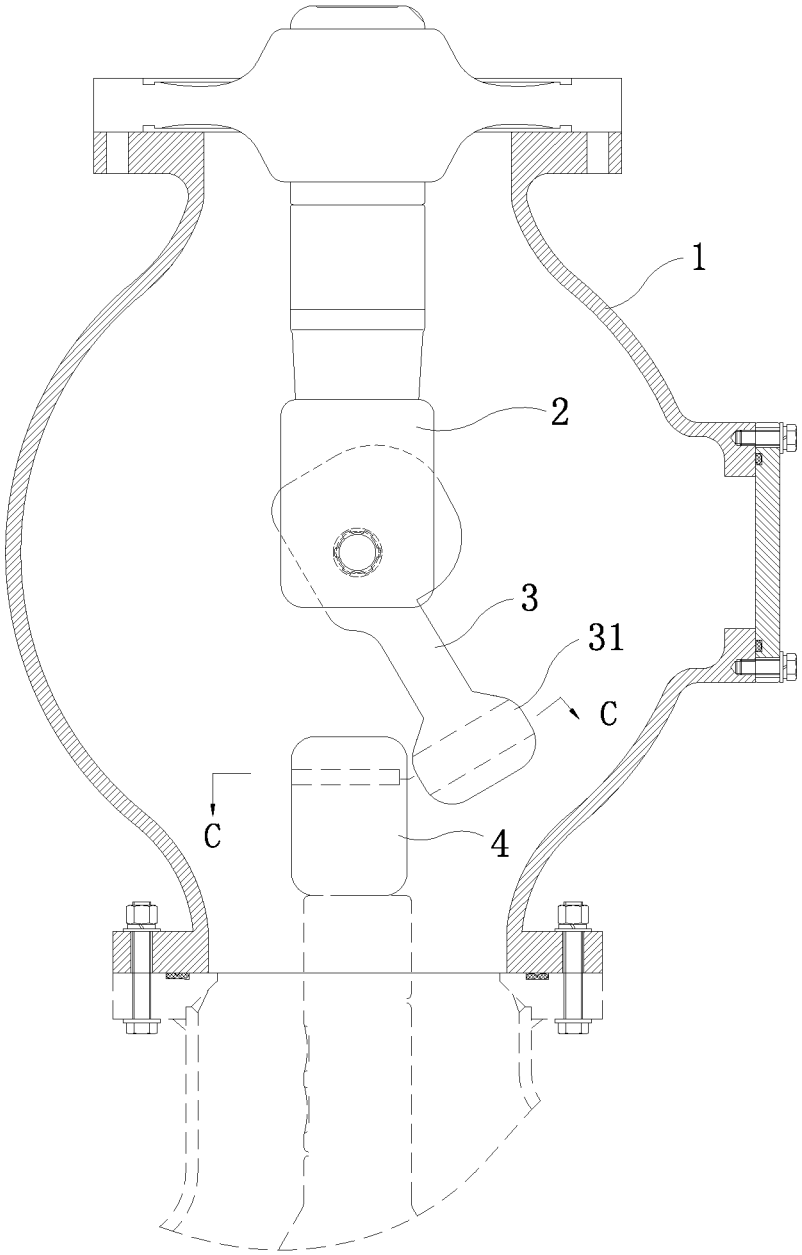
FIG. 10 is a schematic view of the knife switch in a disconnected state of the present invention (the movable contact part is fully separated from the fixed contact part)
Figure 11:
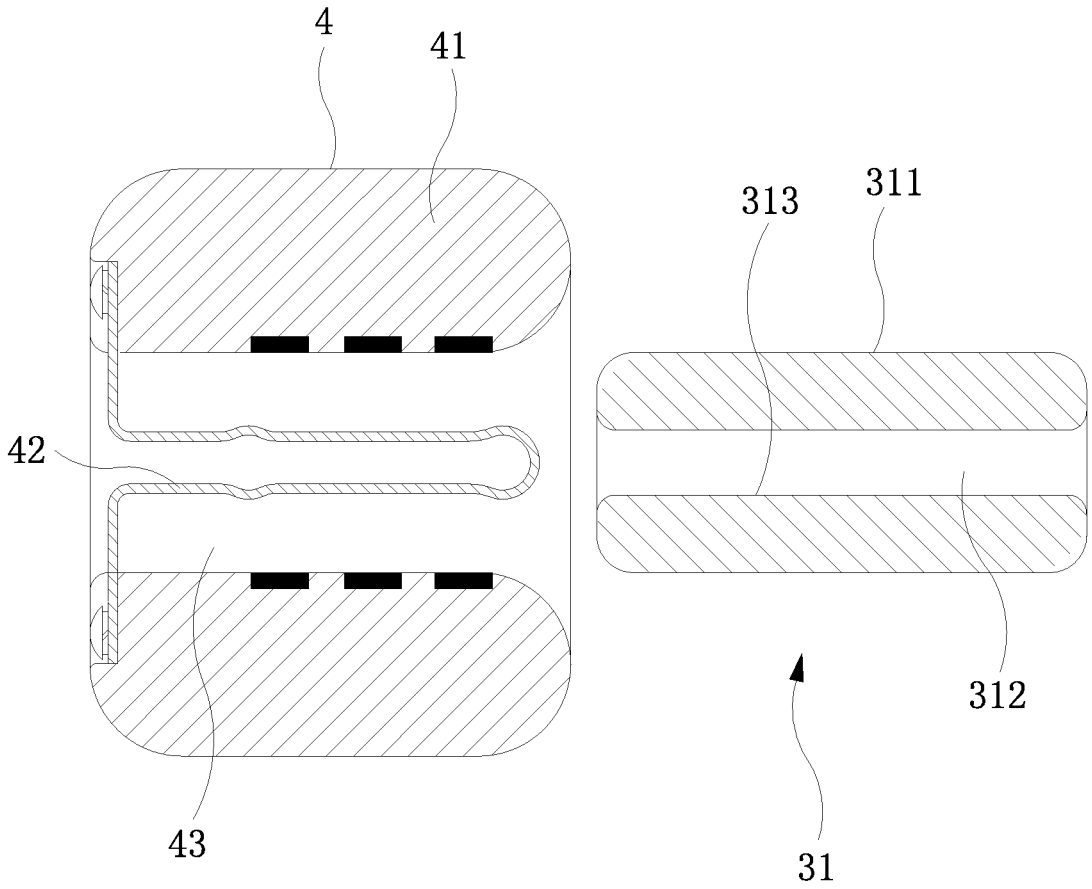
FIG. 11 is a cross-sectional view taken along line C-C of FIG. 10.

As shown in FIG. 10 and FIG. 11, when the movable contact part 3 continues to move away from the fixed contact part 4, the arc guide contact plate 42 is separated from the arc guide hole 312 of the movable contact part 3. Thus, an electric arc is generated between the arc guide contact plate 42 and the second conductive surface 313 of the arc guide hole 312, and the arc is burned in the arc guide hole 312. When the current crosses zero, the arc goes out.

In summary, the key point of the present invention is that the first conductive surface 311 of the movable contact part 3 is in contact with the contact finger 41 of the fixed contact part 4 to realize the electrical connection between the two, and "from the first conductive surface 311 to the contact finger 41 and then to the fixed contact part 4" serves as a main current path between the movable and fixed contact parts. In addition, in the present invention, the arc guide contact plate 42 is disposed in the fixed contact part 4, and the arc guide hole 312 having the second conductive surface 313 is disposed in the movable contact part 3. Through the arc guide contact plate 42 to be in contact with the second conductive surface 313 of the arc guide hole 312, "from the second conductive surface 313 to the arc guide contact plate 42 and then to the fixed contact part 4" serves as an auxiliary current path between the movable and fixed contact parts. When the knife switch performs a disconnecting operation, the first conductive surface 311 is first separated from the contact finger 41, and the second conductive surface 313 is still in contact with the arc guide contact plate 42. Thus, there is no electric arc generated between the first conductive surface 311 of the movable contact part 3 and the contact finger 41 due to separation, thereby preventing the electric arc from ablating the first conductive surface 311 and the contact finger 41, so that the main current path between the movable and fixed contact parts is not damaged, so as to ensure the normal conductive performance of the knife switch.

When the knife switch continues to perform the disconnecting operation, the arc guide contact plate 42 is disengaged from the arc guide hole 312, and an electric arc is generated between the second conductive surface 313 and the arc guide contact plate 42 due to separation. Since the second conductive surface 313 is formed in the arc guide hole 312, the electric arc burns only in the arc guide hole 312 until it goes out. That is to say, through the arrangement of the arc guide contact plate 42 and the arc guide hole 312, the electric arc between the movable and fixed contact parts burns only in the arc guide hole 312 and does not move to other locations, thereby protecting the first conductive surface 311 and the contact finger 41 from electric arc ablation.

For the arc guide contact plate 42 to be in good contact with the second conductive surface 313, the arc guide contact plate 42 may be an elastic structure, that is, the arc guide contact plate 42 can be compressed in the arc guide hole 312. In this way, the contact between the arc guide contact plate 42 and the second conductive surface 313 is relatively stable, so as to ensure that the arc guide contact plate 42 and the second conductive surface 313 are still in good contact with each other when the first conductive surface 311 is are separated from and the contact finger 41. Specifically, the arc guide contact plate 42 includes two bottom ends 421, two sides 422, and a top end 423. The two bottom ends 421 of the arc guide contact part 42 are fixed in the groove 43 of the fixed contact part 4. The two sides 422 are provided with protrusions 424 to secure the connection between the arc guide contact plate 42 and the second conductive surface 313. When the knife switch is connected, the top end 423 of the arc guide contact plate 42 first enters the arc guide hole 312.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A knife switch, comprising a switch housing, a conductive seat, a movable contact part and a fixed contact part, the conductive seat, the movable contact part and the fixed contact part being disposed in the switch housing, one end of the movable contact part being hinged to the conductive seat and electrically connected to the conductive seat; another end of the movable contact part being formed with a conductive head, an outer surface of the conductive head being defined as a first conductive surface, the conductive head having an arc guide hole that is disposed in the conductive head and extends in a width direction of the movable contact part, an inner side surface of the arc guide hole being defined as a second conductive surface; the fixed contact part being provided with a groove to cooperate with the conductive head; the groove being provided with a contact finger to cooperate with the first conductive surface and an arc guide contact plate to cooperate with the second conductive surface;

wherein the arc guide contact plate is an elastic structure;

wherein the arc guide contact plate includes two bottom ends, two sides and a top end, the two bottom ends of the arc guide contact part are fixed in the groove of the fixed contact part, and the two sides are provided with protrusions.

2. The knife switch as claimed in claim 1, wherein the contact finger is disposed on an inner side of the groove.

3. The knife switch as claimed in claim 1, wherein the groove has an open end facing the movable contact part.

* * * * *